US011040859B2

(12) United States Patent
Shepherd et al.

(10) Patent No.: US 11,040,859 B2
(45) Date of Patent: Jun. 22, 2021

(54) FRAMELESS ELEVATOR COUNTERWEIGHT

(71) Applicant: OTIS ELEVATOR COMPANY, Farmington, CT (US)

(72) Inventors: Kevin Shepherd, Florence, SC (US); Pieter Van Lieu, Florence, SC (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 310 days.

(21) Appl. No.: 16/105,350

(22) Filed: Aug. 20, 2018

(65) Prior Publication Data

US 2020/0055708 A1 Feb. 20, 2020

(51) Int. Cl.
*B66B 17/12* (2006.01)
*B66B 7/02* (2006.01)
*B66B 15/02* (2006.01)

(52) U.S. Cl.
CPC ..... *B66B 17/12* (2013.01); *B66B 7/02* (2013.01); *B66B 15/02* (2013.01)

(58) Field of Classification Search
CPC ..... B66B 17/12; B66B 7/02; B66B 15/02
See application file for complete search history.

(56) References Cited

U.S. PATENT DOCUMENTS 4,236,605 A * 12/1980 Lindbergh ..... B66B 17/12 187/405
5,513,724 A * 5/1996 De Jong ..... B66B 5/284 187/264
2006/0289245 A1* 12/2006 Asami ..... B66B 17/12 187/404
2007/0246307 A1* 10/2007 Cloux ..... B66B 17/12 187/404
2008/0223665 A1* 9/2008 O'Donnell ..... B66B 7/062 187/256
2014/0332325 A1* 11/2014 Lazaro Goicoechea ..... B66B 17/12 187/405
2015/0291396 A1* 10/2015 Nakamura ..... B66B 7/048 187/404
2017/0217733 A1* 8/2017 Mikkonen ..... B66B 17/12
2020/0055708 A1* 2/2020 Shepherd ..... B66B 17/12

FOREIGN PATENT DOCUMENTS

CN 203372970 U 1/2014
CN 206032981 U 3/2017
CN 106672761 A 5/2017
CN 207276008 U 4/2018
DE 1162048 1/1964
(Continued)

OTHER PUBLICATIONS

JPH 10250959—Machine Translation (Year: 1998).*
The Extended European Search Report for EP Application No. 19192709.4, dated Jan. 27, 2020.

*Primary Examiner* — Michael A Riegelman
(74) *Attorney, Agent, or Firm* — Carlson, Gaskey & Olds

(57) ABSTRACT

An illustrative example embodiment of an elevator counterweight includes a frameless stack of a plurality of weights that are connected to maintain a vertical and horizontal alignment of the weights. A plurality of guides are directly supported on at least some of the weights. The plurality of guides are configured to guide movement of the counterweight along elevator guide rails.

18 Claims, 5 Drawing Sheets

(56) References Cited

FOREIGN PATENT DOCUMENTS

| | | | |
|---|---|---|---|
| EP | 1600417 | A1 | 11/2005 |
| EP | 1808399 | A2 | 7/2007 |
| GB | 2270292 | A | 3/1994 |
| JP | S56116371 | | 9/1981 |
| JP | H07097162 | A | 4/1995 |
| JP | H1072179 | | 3/1998 |
| JP | H10250959 | | 9/1998 |
| JP | 2004189366 | A | 7/2004 |
| WO | 2011026777 | | 3/2011 |

* cited by examiner

FRAMELESS ELEVATOR COUNTERWEIGHT

BACKGROUND

Elevator systems are useful for carrying passengers and items between different levels in a building. Different configurations of elevator systems have been used for many years. One type of elevator system configuration relies upon traction between a drive sheave or traction sheave and the load bearing members, such as round steel ropes or flat belts, that support the elevator car and a counterweight. In such elevator systems, movement of the traction sheave results in movement of the load bearing members and corresponding movement of the elevator car.

Counterweights are provided in elevator systems for known reasons. One issue associated with many counterweights is that they tend to be expensive and space-inefficient. Typical counterweights require separate provisions for guides to follow along guiderails, filler weight retention and alignment, connection with the roping assembly, and significant structural provision to retain all of the weight. Additionally, heavier counterweights tend to require larger frames which require even more space. Adding hoistway space to accommodate a larger counterweight tends to add significant cost because that requires a deeper pit, higher overhead clearance, a wider hoistway, or a combination of them. Further, more expensive structural materials are often used for larger sized counterweights.

SUMMARY

An illustrative example embodiment of an elevator counterweight includes a frameless stack of a plurality of weights that are connected to maintain a vertical and horizontal alignment of the weights. A plurality of guides are directly supported on at least some of the weights. The plurality of guides are configured to guide movement of the counterweight along elevator guide rails.

In an example embodiment having one or more features of the elevator counterweight of any of the previous paragraphs, the plurality of weights includes a top weight and a bottom weight. The top weight and the bottom weight each include lateral edges. At least one of the guides is supported near one of the lateral edges, respectively, of the top weight. At least one of the guides is supported near one of the lateral edges, respectively, of the bottom weight.

In an example embodiment having one or more features of the elevator counterweight of any of the previous paragraphs, a portion of each of the guides extends laterally beyond the lateral edges.

In an example embodiment having one or more features of the elevator counterweight of any of the previous paragraphs, the weights respectively include a channel on each of two oppositely facing lateral edges, the channels are aligned vertically and the channels are configured to receive a portion of an elevator guiderail within the channel.

In an example embodiment having one or more features of the elevator counterweight of any of the previous paragraphs, the guides are at least partially situated within the channel of the at least some of the weights.

In an example embodiment having one or more features of the elevator counterweight of any of the previous paragraphs, the guides respectively comprise a piece of low friction material secured to the at least some of the weights within the channels.

In an example embodiment having one or more features of the elevator counterweight of any of the previous paragraphs, the guides extend along an entire height of the channels.

In an example embodiment having one or more features of the elevator counterweight of any of the previous paragraphs, the guides at least partially secure the weights in the horizontal alignment.

In an example embodiment having one or more features of the elevator counterweight of any of the previous paragraphs, the weights each include an opening through the weight and the counterweight comprises a tie rod received at least partially in the openings, the tie rod securing the weights in the vertical and horizontal alignment.

In an example embodiment having one or more features of the elevator counterweight of any of the previous paragraphs, the weights respectively comprise at least one of a boss and a recess. The bosses are sized to be received into the recesses. The boss on one of the weights is received into the recess on another one of the weights to securely interconnect the ones of the weights together.

In an example embodiment having one or more features of the elevator counterweight of any of the previous paragraphs, the weights respectively comprise at least one of a lug and a recess. The recesses are sized to receive at least a portion of the lugs. The lug on one of the weights is received into the recess on another one of the weights to securely interconnect the ones of the weights together.

In an example embodiment having one or more features of the elevator counterweight of any of the previous paragraphs, the lugs extend at least partially from a lateral edge of the weights and the recesses are at least partially formed along a lateral edge of the weights.

An example embodiment having one or more features of the elevator counterweight of any of the previous paragraphs includes at least one sheave supported on at least one of the weights, the sheave being rotatable relative to the at least one of the weights about an axis that remains stationary relative to the at least one of the weights.

An illustrative example embodiment of an elevator system includes the elevator counterweight of any of the previous paragraphs.

An example embodiment having one or more features of the elevator system of any of the previous paragraphs includes at least one guiderail and wherein the weights respectively include a channel that is configured to receive at least a portion of the guiderail.

In an example embodiment having one or more features of the elevator system of any of the previous paragraphs, the guides are secured at least partially within the recess of at least two of the weights and the guides contact the portion of the guiderail.

In an example embodiment having one or more features of the elevator system of any of the previous paragraphs, the guides comprise pieces of low friction material lining the recesses of all of the weights. The guides at least partially secure the weights in the horizontal alignment.

In an example embodiment having one or more features of the elevator system of any of the previous paragraphs, the at least one guiderail comprises two guiderails, the guiderails are situated on opposite sides of the weights, the guiderails are spaced apart a first distance and the weights include lateral edges that are spaced apart a second distance that is greater than the first distance.

In an example embodiment having one or more features of the elevator system of any of the previous paragraphs, the weights are secured together by at least one of cooperating bosses or lugs and correspondingly shaped recesses on the weights or tie rods received at least partially through an opening in the weights.

An example embodiment having one or more features of the elevator system of any of the previous paragraphs includes at least one sheave supported on at least one of the weights, the sheave being rotatable relative to the at least one of the weights about an axis that remains stationary relative to the at least one of the weights.

The various features and advantages of at least one disclosed example embodiment will become apparent to those skilled in the art from the following detailed description. The drawings that accompany the detailed description can be briefly described as follows.

DETAILED DESCRIPTION

Embodiments of this invention include frameless counterweights that make efficient use of space and offer the capability to realize a heavier counterweight in an economical manner.

Figure 1:
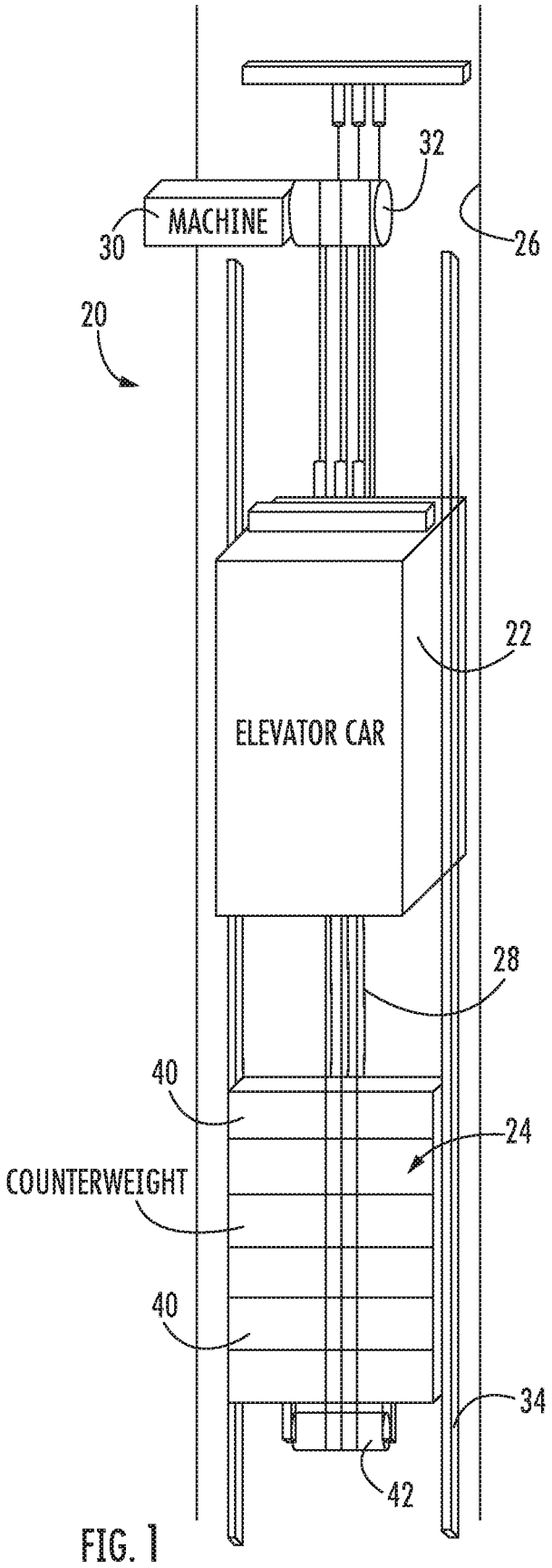
FIG. 1 schematically illustrates selected portions of an elevator system including an elevator counterweight designed according to an embodiment of this invention.

FIG. 1 schematically illustrates selected portions of an elevator system 20. An elevator car 22 and counterweight 24 are situated within a hoistway 26. A plurality of load bearing members 28, such as round steel ropes or flat belts, support the elevator car 22 and counterweight 24. A machine 30, which includes a motor and brake, controls movement of a traction sheave 32 to control movement of the load bearing members 28, which controls movement of the elevator car 22 and counterweight 24. Counterweight guiderails 34 are illustrated in FIG. 1 but guiderails for the elevator car 22 are not shown. Those skilled in the art will understand that more components are required in the elevator system 20, such as elevator car guiderails.

The counterweight 24 is frameless and includes a plurality of weights 40 in a stack. The weights 40 are connected together in a way that maintains a vertical and horizontal alignment between the weights 40 without requiring an external frame. In the example of FIG. 1, a sheave 42 is supported beneath the stack of weights 40 in an underslung manner. An underslung configuration, such as that shown in the example of FIG. 1, contributes to eliminating a need for a structural frame for the counterweight 24, in part, because the sheave 42 effectively supports the stack of weights 40 and the load bearing members 28 are beneath the sheave 42.

Figure 2:
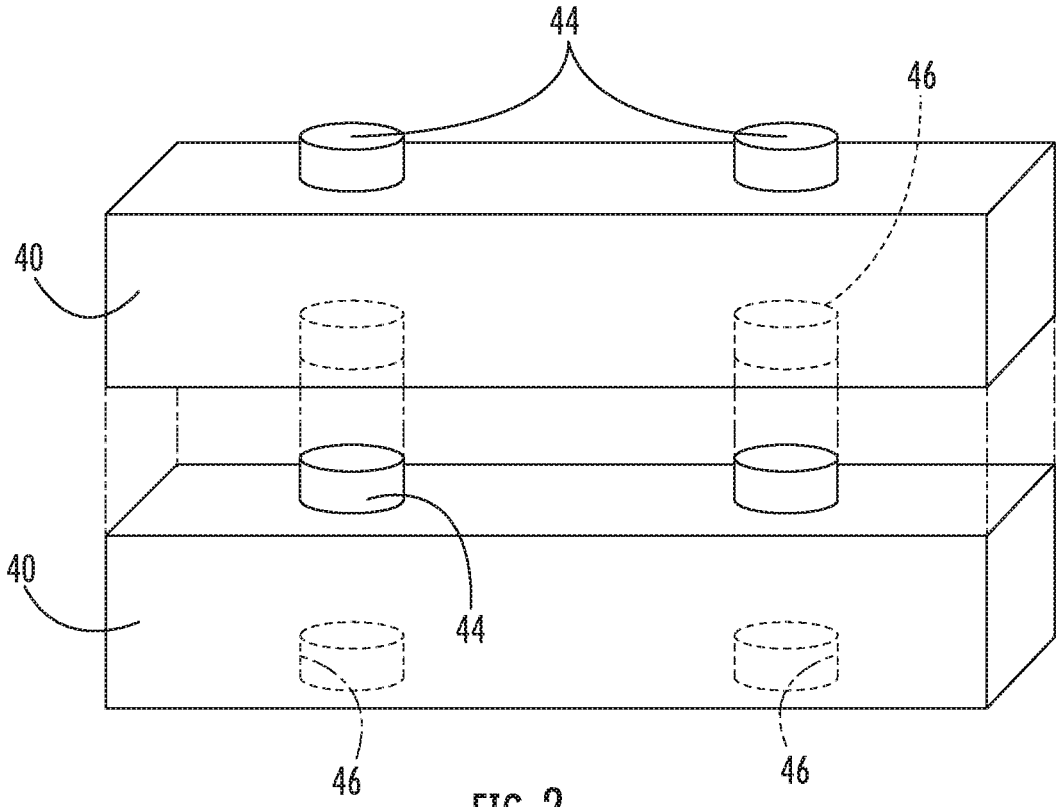
FIG. 2 schematically illustrates an example arrangement of connecting features for securing weights together.

FIG. 2 illustrates one example way in which the weights 40 are connected together. Each of the weights 40 in this example includes at least one boss 44 and at least one correspondingly shaped recess 46. The bosses 44 on one of the weights 40 are received into the recesses 46 on an adjacent one of the weights 40 when the stack of weights 40 are assembled.

Figure 3:
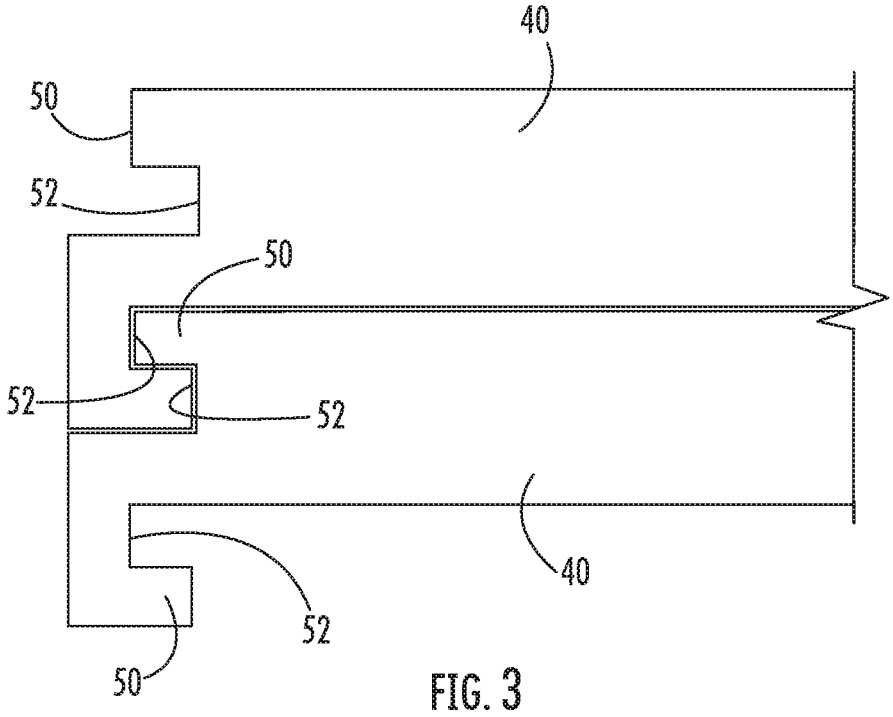
FIG. 3 schematically illustrates another example arrangement of securing features to secure weights together.

FIG. 3 illustrates another arrangement for securing the weights 40 together. This example includes a plurality of lugs 50 and recesses 52. The lugs 50 are received into corresponding recesses 52 to secure the weights 40 to each other. When the weights 40 are secured to each other using features like those shown in FIGS. 2 and 3, the weights 40 remain in a desired vertical and horizontal alignment with each other without requiring an external frame to hold the weights 40 in appropriate positions.

Figure 4:
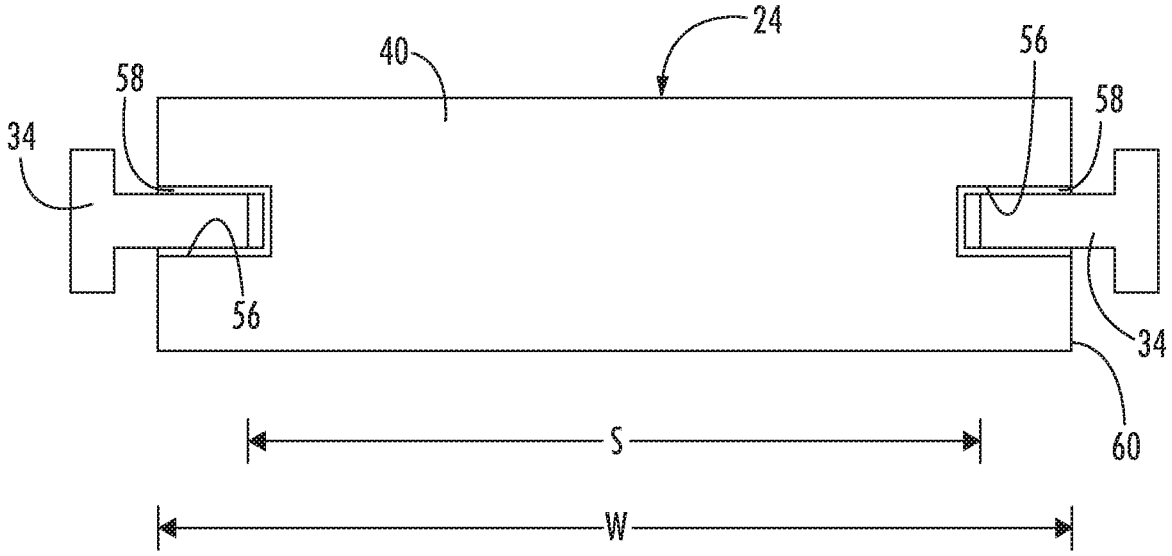
FIG. 4 illustrates a selected feature of an example embodiment from a first perspective.
Figure 5:
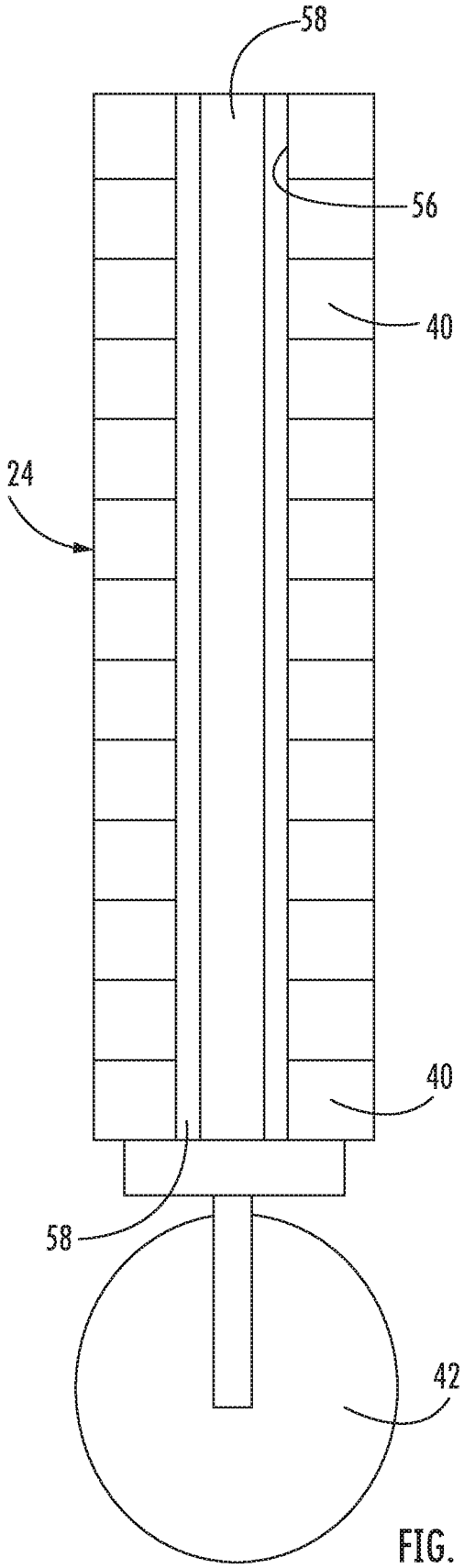
FIG. 5 illustrates the feature shown in FIG. 4 from another perspective.

As shown in FIGS. 4 and 5, the illustrated example embodiment of the counterweight 24 includes recesses 56 that receive guides 58, which facilitate movement of the counterweight 24 along the guiderails 34. The recesses 56 extend inward toward a center of the weights 40 on lateral edges 60 of each weight 40. The guides 58 in some embodiments are received in only some of the weights 40. In the example illustration of FIG. 5, the guides 58 extend along an entire length or height of the stack of weights 40. In some such arrangements, the guides 58 have sufficient stiffness or rigidity to contribute to maintaining the horizontal alignment of the weights 40.

The guides 58 in the illustrated example embodiment comprise a strip or sheet of low friction material for sliding along a portion of the guiderails 34. Other embodiments include guides that have rollers that follow along the guiderails 34.

One feature of the example embodiment shown in FIGS. 4 and 5 is that a spacing S between the guiderails 34 is smaller than a width W or spacing between the lateral edges 60 of the weights 40. This configuration allows for a portion of the weights 40 to extend horizontally further outward than the spacing S between the guiderails 34. This configuration is different than counterweights that include a frame, in part, because the frame typically has to occupy space between the guiderails, which requires the filler weights to be even smaller. With the illustrated example embodiment, on the other hand, the weights 40 can be wider making more efficient use of space within the hoistway because more weight per unit height can be incorporated into the counterweight 24 compared to framed counterweight designs.

Figure 6:
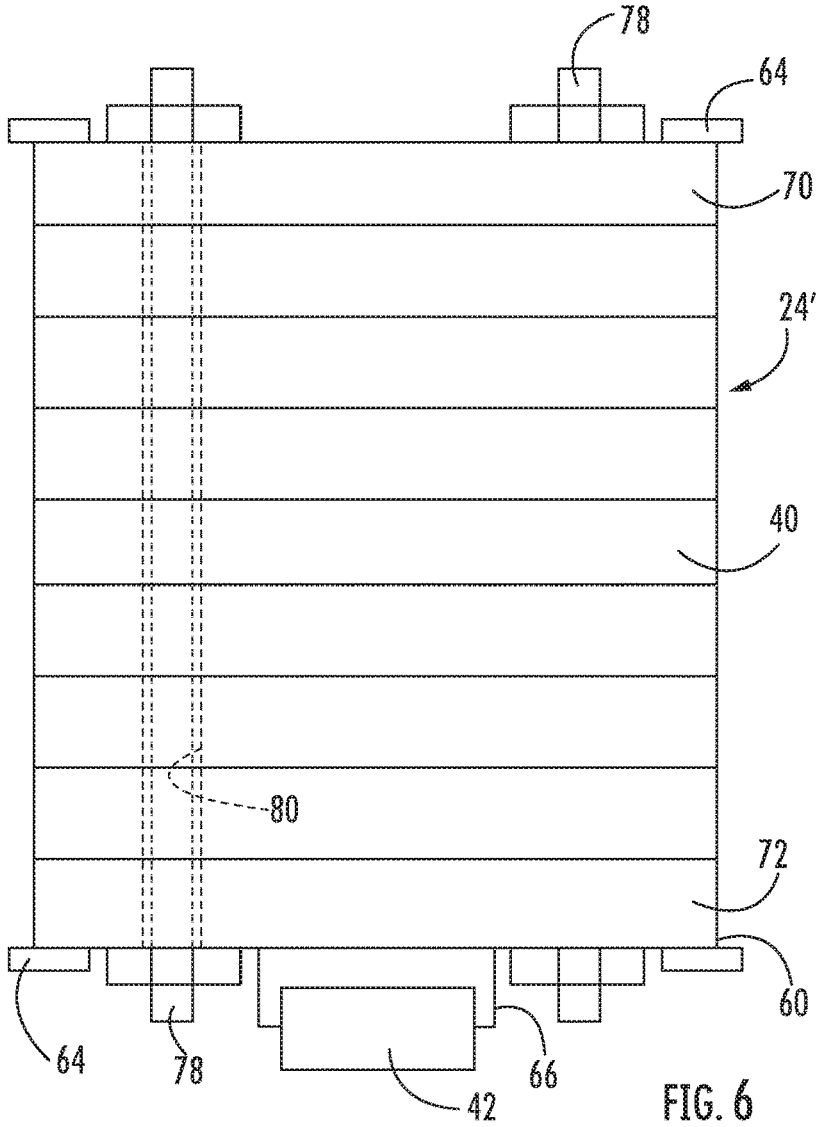
FIG. 6 illustrates another frameless counterweight configuration designed according to an embodiment of this invention.
Figure 7:
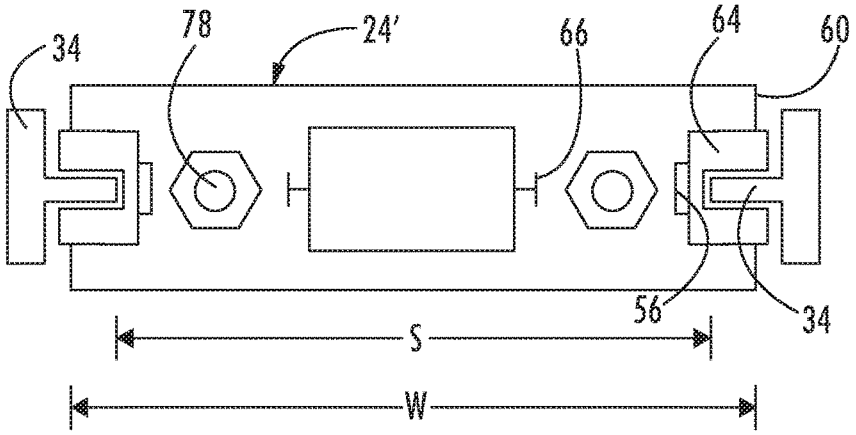
FIG. 7 illustrates selected features of the embodiment shown in FIG. 6.

FIGS. 6 and 7 illustrate another example embodiment of a counterweight 24'. In this embodiment, the weights 40 include guides 64 situated near the lateral edges 60 of a top weight plate 70 and a bottom weight plate 72. The guides 64 in this example extend beyond the lateral edges 60 of the weights 40. The weights 40 in this embodiment also include recesses 56 configured to receive at least a portion of the guiderails 34, respectively. Again, the ability to have portions of the weights 40 situated further apart than the spacing S between the guiderails 34 makes more efficient use of space within the hoistway 26 and allows for realizing heavier counterweights without requiring excessive height.

The bottom weight plate 72 in this example includes supports 66 that support the sheave 42 in an underslung configuration. In another embodiment configured similar to that shown in FIGS. 6 and 7, the supports 66 for the sheave 42 are secured to the top weight plate 70.

As shown in FIGS. 6 and 7, tie rods 78 are received through openings 80 in the weights 40. The tie rods 78 secure the weights 40 together to maintain a vertical and horizontal alignment of them. Tie rods 78 may be used in combination with other connecting features, such as those shown in FIGS. 2 and 3.

The illustrated embodiments and others allow for realizing the required functionality of a counterweight within an elevator system without requiring a frame that surrounds and supports filler weights. Instead, the weights 40 are in a frameless stack on which the guides 58, 64 are directly supported. Additionally, the components for suspending the counterweight 24 within the hoistway 26 are incorporated onto or connected to at least one of the weights without requiring separate frame components.

While different embodiments are illustrated and described above, the various features of them are not limited to the particular embodiment shown. Variations and combinations other than those illustrated are possible to realize other embodiments. In other words, one or more features of each of the illustrated embodiments may be combined with one or more features of another embodiment.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator counterweight, comprising:

a frameless stack of a plurality of weights that are connected to maintain a vertical and horizontal alignment of the weights; and a plurality of guides configured to guide movement of the counterweight along guiderails, the plurality of guides being directly supported on at least some of the weights, wherein the weights respectively include a channel on each of two oppositely facing lateral edges, the channels are aligned vertically, and the channels are configured to receive at least a portion of one of the guiderails within the channel.

2. The elevator counterweight of claim 1, wherein the plurality of weights includes a top weight and a bottom weight;

at least one of the guides is supported on one of the lateral edges, respectively, of the top weight; and at least one of the guides is supported on one of the lateral edges, respectively, of the bottom weight.

3. The elevator counterweight of claim 2, wherein a portion of each of the guides extends laterally beyond the lateral edges.

4. The elevator counterweight of claim 1, wherein the guides are at least partially situated within the channel of the at least some of the weights.

5. The elevator counterweight of claim 4, wherein the guides respectively comprise a piece of low friction material secured to the at least some of the weights within the channels.

6. The elevator counterweight of claim 5, wherein the guides extend along an entire height of the channels.

7. The elevator counterweight of claim 6, wherein the guides at least partially secure the weights in the horizontal alignment.

8. The elevator counterweight of claim 1, wherein the weights each include an opening through the weight; and the counterweight comprises a tie rod received at least partially in the openings, the tie rod securing the weights in the vertical and horizontal alignment.

9. The elevator counterweight of claim 1, wherein the weights respectively comprise at least one of a boss and a recess;

the bosses are sized to be received into the recesses;

the boss on one of the weights is received into the recess on another one of the weights to securely interconnect the ones of the weights together.

10. The elevator counterweight of claim 1, wherein the weights respectively comprise at least one of a lug and a recess;

the recesses are sized to receive at least a portion of the lugs; and the lug on one of the weights is received into the recess on another one of the weights to securely interconnect the ones of the weights together.

11. The elevator counterweight of claim 10, wherein the lugs extend at least partially from a lateral edge of the weights; and the recesses are at least partially formed along a lateral edge of the weights.

12. The elevator counterweight of claim 1, comprising at least one sheave supported on at least one of the weights, the sheave being rotatable relative to the at least one of the weights about an axis that remains stationary relative to the at least one of the weights.

13. An elevator system comprising an elevator car and the elevator counterweight of claim 1.

14. The elevator system of claim 13, wherein the guides are secured at least partially within the recess of at least two of the weights; and the guides contact the portion of the one of the guiderails.

15. The elevator system of claim 14, wherein the guides comprise pieces of low friction material lining the recesses of all of the weights; and the guides at least partially secure the weights in the horizontal alignment.

16. The elevator system of claim 13, wherein the guiderails are situated on opposite sides of the weights;

the guiderails are spaced apart a first distance; and the lateral edges are spaced apart a second distance that is greater than the first distance.

17. The elevator system of claim 13, wherein the weights are secured together by at least one of cooperating bosses or lugs and correspondingly shaped recesses on the weights or tie rods received at least partially through an opening in the weights.

18. The elevator system of claim 13, comprising at least one sheave supported on at least one of the weights, the sheave being rotatable relative to the at least one of the weights about an axis that remains stationary relative to the at least one of the weights.

* * * * *